US007980782B2

(12) United States Patent
Bleiner et al.

(10) Patent No.: US 7,980,782 B2
(45) Date of Patent: Jul. 19, 2011

(54) TRAFFIC SAFETY INTEGRATED SYSTEM, PARTICULARLY IN LOW VISIBILITY CONDITIONS AND METHOD OF USE OF SAME

(75) Inventors: Thomas Bleiner, Montagonla (CH); Bruno Dessert-Vidalet, Longare (IT)

(73) Assignee: Astron Fiamm Safety S.p.A., Montecchio Maggiore (IT)

( * ) Notice: Subject to any disclaimer, the term of this patent is extended or adjusted under 35 U.S.C. 154(b) by 889 days.

(21) Appl. No.: 11/572,261

(22) PCT Filed: Aug. 1, 2005

(86) PCT No.: PCT/IB2005/001805

§ 371 (c)(1),
(2), (4) Date: Aug. 4, 2007

(87) PCT Pub. No.: WO2006/013406

PCT Pub. Date: Feb. 9, 2006

(65) Prior Publication Data

US 2008/0044224 A1 Feb. 21, 2008

(30) Foreign Application Priority Data

Jul. 30, 2004 (IT) ..... VI2004A0192

(51) Int. Cl.
*E01F 9/016* (2006.01)

(52) U.S. Cl. ..... 404/9; 404/12; 404/15

(58) Field of Classification Search ..... 404/6–16
See application file for complete search history.

(56) References Cited

U.S. PATENT DOCUMENTS

| | | | | |
|---|---|---|---|---|
| 3,836,275 | A * | 9/1974 | Finch | 404/13 |
| 3,893,000 | A * | 7/1975 | Guercio | 315/159 |
| 4,668,120 | A * | 5/1987 | Roberts | 404/12 |
| 4,993,868 | A * | 2/1991 | Eigenmann | 404/12 |
| 5,128,670 | A * | 7/1992 | Jackson et al. | 340/907 |
| 5,134,393 | A * | 7/1992 | Henson | 340/933 |
| 5,277,516 | A * | 1/1994 | Strieter | 404/14 |

(Continued)

FOREIGN PATENT DOCUMENTS

DE 3640539 6/1988

(Continued)

*Primary Examiner* — Raymond W Addie
(74) *Attorney, Agent, or Firm* — Themis Law

(57) ABSTRACT

An integrated system for traffic safety (1), particularly in low visibility conditions, for use on a site (2) of a road, railway, airport, harbor or the like, which comprises road markings and/or signs (3). The system (1) comprises at least one light-emitting device (4) for generating at least one light beam (5). One feature of the invention is that it comprises means (6) for controlling the light-emitting device (4) to generate the beam (5). The device has such a predetermined relative position with respect to said site (2) as to selectively interact with the road markings and/or signs (3) and to make the beam (5) only visible to the drivers that drive over the site (2) in a predetermined drive direction, and not to those who drive in the opposite direction. An integrated method for traffic safety, in conditions and sites as described above, including the steps of providing road markings and/or signs (3) on a road site (2) (step a), providing at least one light-emitting device (4) for emitting at least one light beam (5) (step b), emitting the beam (5) (step c) and conforming and orienting it toward the site (2) to selectively hit the road markings and/or signs (3) thereon (step d).

16 Claims, 2 Drawing Sheets

U.S. PATENT DOCUMENTS

| | | | | |
|---|---|---|---|---|
| 5,293,162 | A | 3/1994 | Bachalo | |
| 5,412,381 | A * | 5/1995 | Dicks | 340/908.1 |
| 5,440,116 | A | 8/1995 | Bolander et al. | |
| 5,680,033 | A * | 10/1997 | Cha | 359/542 |
| 5,818,640 | A | 10/1998 | Watanabe | |
| 5,914,661 | A | 6/1999 | Gross | |
| 6,048,069 | A | 4/2000 | Nagaoka et al. | |
| 6,120,879 | A | 9/2000 | Szczech et al. | |
| 6,259,365 | B1 | 7/2001 | Hagar et al. | |
| 6,278,360 | B1 | 8/2001 | Yanagi | |
| 6,429,840 | B1 | 8/2002 | Sekiguchi | |
| 7,021,857 | B2 * | 4/2006 | Van Der Poel | 404/9 |
| 7,044,679 | B2 * | 5/2006 | Groff | 404/16 |
| 2002/0006313 | A1 * | 1/2002 | Pas | 404/13 |
| 2002/0061226 | A1 * | 5/2002 | Kodama et al. | 404/14 |
| 2002/0105805 | A1 | 8/2002 | O'Meara | |
| 2002/0159834 | A1 * | 10/2002 | Hamakawa et al. | 404/14 |
| 2005/0286972 | A1 * | 12/2005 | Gongolas | 404/9 |

FOREIGN PATENT DOCUMENTS

| | | | |
|---|---|---|---|
| DE | 4000630 | | 7/1991 |
| DE | 10146974 | | 4/2003 |
| GB | 2303906 | | 3/1987 |
| GB | 2226134 | | 6/1990 |
| WO | WO 99/15921 | * | 4/1998 |

* cited by examiner

TRAFFIC SAFETY INTEGRATED SYSTEM, PARTICULARLY IN LOW VISIBILITY CONDITIONS AND METHOD OF USE OF SAME

FIELD OF THE INVENTION

This invention finds application in the field of transportation, and particularly relates to a traffic safety integrated system, particularly in low visibility conditions.

The invention further relates to a method of use of such traffic safety system.

BACKGROUND ART

Attention has been recently paid on the increasing number of railway, airport or harbor accidents caused by the collision of two or more vehicles driving on opposite directions, on a roadway in which traffic is normally allowed in one direction.

These accidents always have very serious consequences and may be often related to a poor or insufficient warning of the danger, which affects perception of the prohibition or danger sign by a possibly tired or careless driver.

Furthermore, a number of studies and researches in some European countries have shown that drivers increasingly tend to mistakingly or carelessly enter one-way roads in the wrong direction, such as at the exit of a highway or an expressway.

While case studies have not shown high occurrences, a great number of victims have been noted, thence the problem is relevant.

Although current signs are effective in good weather conditions, they have the drawback of not being equally perceivable in poor visibility conditions.

Road signs, even of the light-emitting type, are not effective in poor visibility conditions and further involve a considerable power consumption.

Also, in case of fog or rain, the effectiveness of such signs is further affected by the halo generated therearound.

Road markings tend to be even less perceivable in rain and fog conditions, and to be completely hidden under the snow.

Furthermore, such markings are exposed to deterioration, due to the passage of vehicles thereon, and cannot be readily made for temporary signalization.

DE-A1-4000630 discloses a wrong-way warning system which, by using sensors under the asphalt or photocells, triggers various devices to stop the wrong-way vehicle, while simultaneously signaling the danger situation to the drivers in the right direction.

Such system has the drawback of only providing a remedy to an error, without proposing any prevention thereof. Any vehicle driving in the right direction immediately upstream from the signaling station would unavoidably collide against the vehicle driving the wrong way. This drawback is even more serious when large and heavy vehicles are involved, such as ships, trains or aircrafts, which have a very long braking distance.

Patent GB-A-2226134 discloses and claims a laser beam security barrier.

Such prior art system has the drawback of only showing the obstacle, and is not suitable for present purpose: all prior art signs do not benefit from the laser beam and remain invisible, especially in low visibility conditions.

Another laser beam barrier, which also involves the above drawbacks, is disclosed in U.S. Pat. No. 6,259,365.

Obstacle detection systems, whether or not based on the use of a laser beam, are also known from EP-A2-1148460, U.S. Pat. Nos. 5,440,116, 6,278,360B1, DE-A1-3640539, DE-A1-10146974, U.S. Pat. Nos. 5,293,162, 5,914,661.

These prior art solutions all have the drawback of only detecting the obstacle at a given distance, when it might be too late, especially in bad weather conditions.

SUMMARY OF THE INVENTION

The object of this invention is to overcome the above drawbacks, while providing an integrated system for traffic safety, particularly in low visibility conditions, that is practical, cost-effective and most of all efficient.

A particular object is to provide a system that allows to highlight the signs or markings on the roadway, in case of good visibility, and possibly at least replace those signs or markings in case of low visibility.

A further object is to provide a system that increases visibility of the signs as weather conditions worsen.

Yet another object of the invention is to provide a temporary danger warning device.

Another object of the invention is to provide a device that has a low power consumption and high endurance.

Finally, an object of the invention is to provide an integrated method for traffic safety, that ensures the highest effectiveness, reliability and safety for users.

These objects, as well as other objects that will be more apparent hereinafter, are fulfilled by a traffic safety integrated system for a traffic site in accordance with the invention, comprises at least one light-emitting device for generating at least one light beam, characterized in that it comprises means for controlling said at least one device for generating said at least one beam, said device having such a predetermined relative position with respect to said site, as to selectively interact with the road markings and/or signs.

Thanks to this particular configuration, the device of the invention allows to enhance visibility of the above mentioned markings and/or signs, and to make the beam only visible to the drivers that drive over said site in a predetermined drive direction, and not to those who drive in the opposite direction.

In another aspect of the invention, there is provided a traffic safety integrated method, includes the steps of providing at least one light-emitting device (4) for emitting at least one light beam, emitting said at least one light beam and conforming and orienting said at least one light beam toward said site, said device having a predetermined relative position with respect to said site.

BRIEF DESCRIPTION OF THE DRAWINGS

Further features and advantages of the invention will be more apparent from the detailed description of a preferred, non-exclusive embodiment of a system according to the invention, which is described as a non-limiting example with the help of the annexed drawings, in which.

DETAILED DESCRIPTION OF A PREFERRED EMBODIMENT

Figure 1:
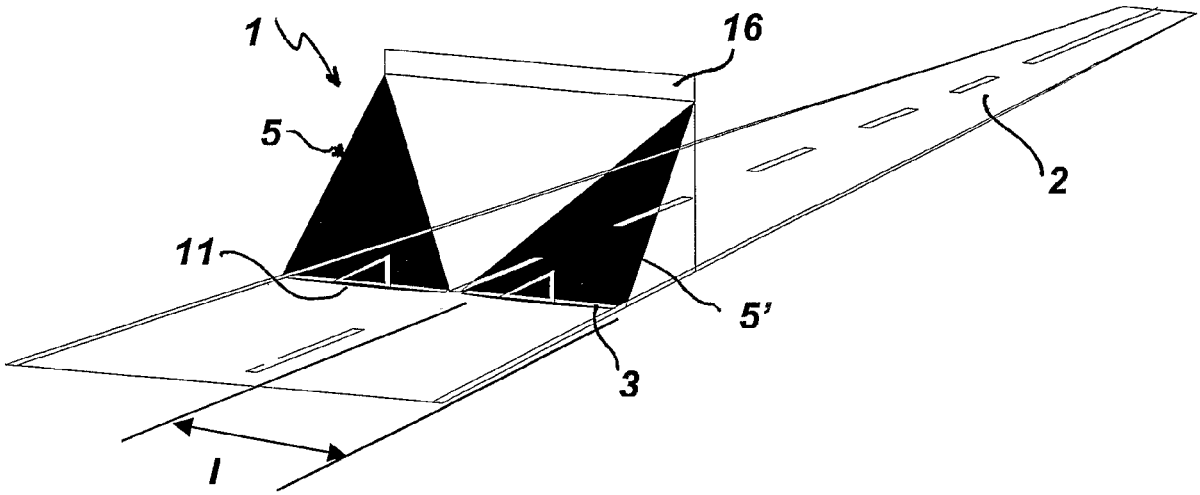
FIG. 1 is an assembly view of the system of the invention, in operation.
Figure 2:
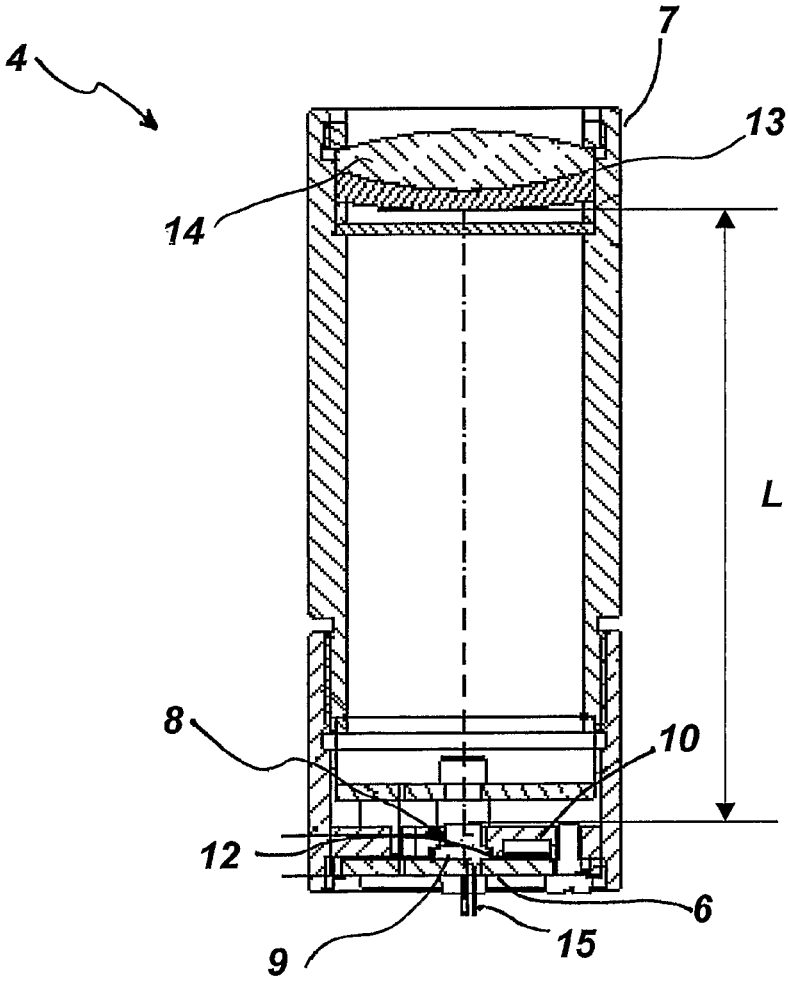
FIG. 2 is a sectional view of a detail of FIG. 1.
Figure 3:
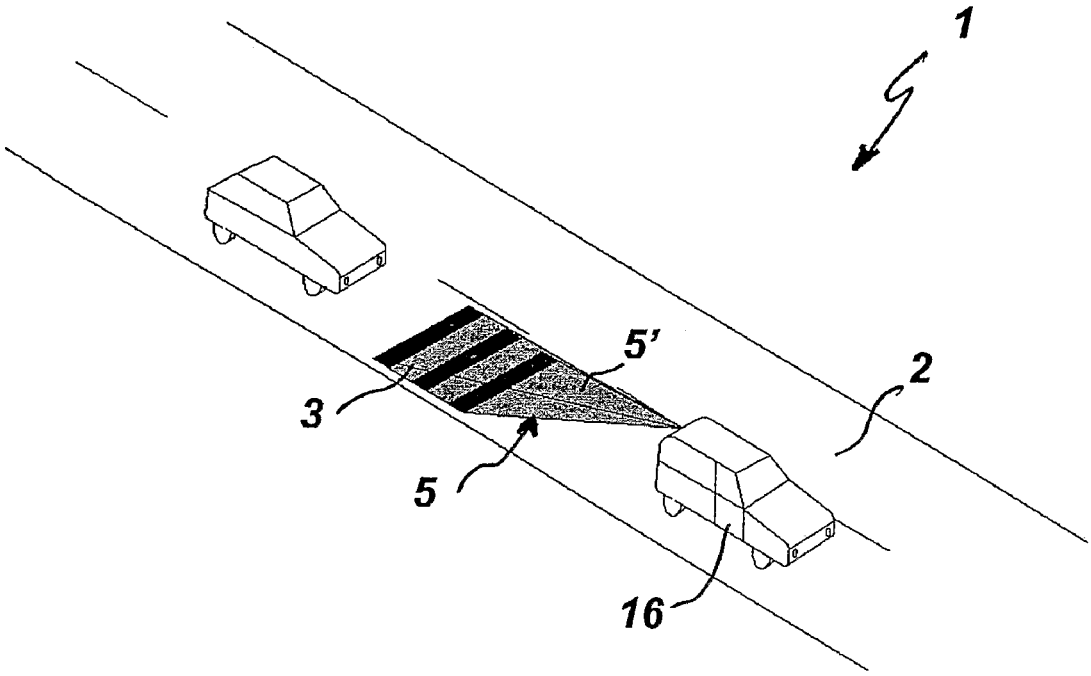
FIG. 3 is an assembly view of a particular configuration of the system of the invention, in operation.
Figure 4:
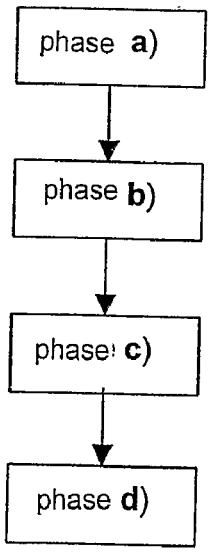
FIG. 4 is a flow chart of a method of using the integrated system for traffic safety in accordance with the invention.

Referring to the Figures, the system of the invention, which is generally denoted by numeral 1, is designed for use on a site 2 of a road, railway, airport, harbor or the like, which comprises road markings and/or signs 3.

To this end, the system 1 comprises at least one light-emitting device 4 for emitting at least one light beam 5.

Particularly, the light-emitting device 4 may include at least one projector 7, preferably comprising at least one semiconductor source 8.

This arrangement is particularly advantageous, as this type of light source has a very low power consumption when compared to traditional sources, and this increases the endurance of the device 4, and of the system 1 in general, as well as the perception distance.

Advantageously, the semiconductor source 8 may be of the laser or LED type, which assures the best results at the lowest costs.

According to the invention, the system 1 comprises means 6 for controlling said at least one device 4, which are adapted to conform and orient said at least one beam 5 in such a manner as to selectively interact with the road markings and/or signs 3 in said site 2, to enhance visibility thereof and possibly at least partially replace them, e.g. to warn that a road section has been closed to traffic, or signal a one-way, or a no-entry condition.

The device 4 also has such a predetermined relative position with respect to said site 2 as to selectively interact with the road markings and/or signs 3 and to make the beam 5 only visible to the drivers that drive over said site 2 in a predetermined drive direction, and not to those who drive in the opposite direction.

If this arrangement is of interest in good weather conditions, it is highly advantageous under bad weather.

Under rain, fog or snow, the light beam 5 emitted by the device 4 materializes the particles suspended in the atmosphere, and actually creates a light barrier 5' visible in space, which enhances effectiveness of the markings and/or signs 3.

Furthermore, as the amount of reflected light increases with the amount of particles suspended in the atmosphere, the lower the visibility, the more the system 1 is effective.

Conveniently, the relative position may be defined by the vector distance between said device and the beam projection area.

Such distance may include a length and a predetermined relative angle.

In order to obtain a more effective and targeted control of the projector 7 and/or of the semiconductor source 8, the control means 6 may comprise at least one microprocessor control unit 9. Appropriate programming of such unit may provide, for example, intermittent light beams 5 or sequential emissions, when a multiple source arrangement 8 is provided.

To further increase the effectiveness of the system 1, the projector 7 may comprise optical and/or electronic means 10 for generating images 11 in space or over a substantially flat surface. Thanks to such means 10, the use of the device 1 is even more effective.

In case of snow fall, when road markings 3 are hidden by the snow cover, the beam 5 materializes the light barrier 5' and the means 10 simultaneously project an image 11, possibly a danger sign complying with the Road Rules, thereby enhancing signalization. This image 11 will remain even when the precipitation stops, thence when there are no suspended particles in the atmosphere and the light barrier 5' is no longer perceivable.

Preferably these means 10 may include an electronic card 12 for generating electronic images.

Furthermore, the projector 7 may have light diffusing means 13, selected from the group consisting of lenses, prisms, mirrors, LCD electron mirrors, micromirrors.

Advantageously, these means 13 may comprise at least one diffractive lens 14.

The combined use of the means 10 and 13 will further increase the effectiveness of the system 1: in addition to the above mentioned barrier 5', an image 11 is also displayed, e.g. a general danger road sign, which will enhance signalization.

Preferably, the microprocessor control unit 9 includes adjustment means, not shown, for changing the distance L of said diffractive lens 14 from the semiconductor source 8.

This allows to change the size I of the light beam 5 and/or of the projected images 11.

By this arrangement, the projector 7 may generate various kinds of images 11, including monochromatic, polychromatic and/or holographic images, possibly having a variable configuration. For example, a sequence of a danger sign and a no-entry sign, or vice versa, may be displayed.

The images 11 may further comprise alphanumeric characters, when text is to be added to the sign.

As far as power consumption is concerned, the semiconductor source has a low absorption. Suitably, the system 1 may have means 15 for supplying power to the light-emitting device 4, preferably comprising at least one battery, not shown. Thanks to this arrangement, the system 1 is particularly suitable for temporary use, e.g. for warning of accidental danger conditions, such as accidents or short-duration works.

Advantageously, the system 1 may be equipped with means, not shown, for securing the device 4 to a support structure 16, preferably selected from the group consisting of a tripod, a guardrail, a highway panel and/or a maintenance or rescue vehicle.

The integrated system for traffic safety as described above may be used as follows.

After the step a, in which appropriate road markings and/or signs 3 have been provided on a site 2 of a road, railway, airport, harbor or the like, a step b, of provision of at least one light-emitting device 4 to generate at least one light beam 5, and a step c of emission of the light beam 5 are executed. These steps are followed by the step d in which the light beam 5 is controlled in such a manner that it is conformed and oriented toward said site 2 to selectively hit the road marks and/or signs 3 to enhance their visibility and possibly at least partially replacing them.

Thanks to the particular selectivity of this method, the system is particularly effective and safe, especially in bad weather conditions, as stated above.

Furthermore, thanks to the simplicity of the means being used, failures rarely occur, whereby the method is particularly reliable with time.

From the above disclosure, the system of the invention proves to fulfill the proposed objects and particularly to enhance visibility of the road markings and/or signs 3 on the road site 2, and possibly to at least partially replace them.

By particularly conforming and orienting the beam 5 by the control means 6, only the relevant signs are selectively lit, which makes them only visible to the vehicles driving in the direction opposite to the normal drive direction over the site 2.

The system and method of use according to this invention are susceptible to a number of changes and variants, within the inventive concept disclosed in the annexed claims. All the details thereof may be replaced by other technically equivalent parts, and the materials may vary depending on different needs, without departure from the scope of the invention.

While the system has been described with particular reference to the accompanying figures, the numerals referred to in the disclosure and claims are only used for the sake of a better intelligibility of the invention and shall not be intended to limit the claimed scope in any manner.

The invention claimed is:

1. A traffic safety integrated system for a site of a road, railway, airport, or harbor having low visibility conditions, comprising:

one or more of road markings provided on a traffic area of said site;

at least one light-emitting device for generating at least one light beam, the light-emitting device being disposed at a distance from the traffic area and comprising, a housing, a semiconductor source comprising a laser source or a LED generating the at least one light beam, and a projector projecting the at least one light beam toward the one or more road markings, the semiconductor source and the projector being disposed within the housing;

a support structure securing said light-emitting device in a predetermined stationary position with respect to said site; and means for controlling said at least one light-emitting device for generating said at least one beam, wherein said beam generates an image corresponding to said one or more road markings that is visible to drivers driving over said traffic area in a predetermined drive direction, and not to drivers driving in an opposite direction, wherein said means for controlling comprise at least one microprocessor control unit for controlling said at least one projector or said semiconductor source, and wherein said microprocessor control unit comprises adjustment means, for adjusting a distance of a diffractive lens to said semiconductor source, such to change size of said at least one light beam or of said projected images, thereby alerting the drivers about the one or more road markings and increasing traffic safety.

2. The system as claimed in claim 1, wherein said predetermined relative position is defined by a vector distance between said at least one light-emitting device and a beam projection area.

3. The system as claimed in claim 1, wherein said projector further comprises one or more of electronic means for generating images in space or over a substantially flat surface.

4. The system as claimed in claim 3, wherein said images include one or more holographic images.

5. The system as claimed in claim 1, wherein said image comprises alphanumeric characters.

6. The system as claimed in claim 3, wherein said electronic means comprise an electronic card.

7. The system as claimed in claim 1, wherein said distance comprises a length and a relative angle.

8. The system as claimed in claim 1, wherein said at least one projector comprises a lens, a prism, a mirror, a LCD electron mirror, or a micro-mirror.

9. The system as claimed in claim 1, wherein said at least one projector comprises at least one diffractive lens.

10. The system as claimed in claim 1, further comprising means for supplying power to said light-emitting device, said power supply means comprising at least one battery.

11. The system as claimed in claim 1, wherein said support structure is selected from the group consisting of a tripod, a guardrail, a highway panel, a maintenance vehicle, or a rescue vehicle.

12. A traffic safety integrated system for a site of a road, railway, airport, or harbor having low visibility conditions, comprising:

one or more signs provided on a shoulder of said site;

at least one light-emitting device for generating at least one light beam, the light-emitting device comprising, a housing, a semiconductor source comprising a laser source or a LED generating the at least one light beam, and a projector projecting the at least one light beam toward the one or more signs, the semiconductor source and the projector being disposed within the housing;

a support structure securing said light-emitting device in a predetermined stationary position with respect to said site; and means for controlling said at least one light-emitting device for generating said at least one beam, wherein said beam generates an image corresponding to said one or more signs that is visible to drivers driving along said shoulder in a predetermined drive direction, and not to drivers driving in an opposite direction, wherein said means for controlling comprise at least one microprocessor control unit for controlling said at least one projector or said semiconductor source, and wherein said microprocessor control unit comprises adjustment means, for adjusting a distance of a diffractive lens to said semiconductor source, such to change size of said at least one light beam or of said projected images, thereby alerting the drivers about the one or more signs and increasing traffic safety.

13. The system as claimed in claim 12, wherein said predetermined relative position is defined by a vector distance between said at least one light-emitting device and a beam projection area.

14. The system as claimed in claim 12, wherein said projector further comprises one or more of electronic means for generating images in space or over a substantially flat surface.

15. The system as claimed in claim 14, wherein said images include one or more holographic images.

16. The system as claimed in claim 12, wherein said image comprises alphanumeric characters.

* * * * *